United States Patent [19]

Kreuter et al.

[11] 4,411,743

[45] Oct. 25, 1983

[54] ELECTROLYTIC PALLADIUM BATH AND PROCESS

[75] Inventors: Erika Kreuter, Rodenbach; Wolfgang Zilske, Hanau, both of Fed. Rep. of Germany

[73] Assignee: Degussa, Frankfurt, Fed. Rep. of Germany

[21] Appl. No.: 370,817

[22] Filed: Apr. 22, 1982

[30] Foreign Application Priority Data

May 13, 1981 [DE] Fed. Rep. of Germany ..... 3118908

[51] Int. Cl.[3] ..... C25D 3/50

[52] U.S. Cl. ..... 204/47

[58] Field of Search ..... 204/47, 43 N, 109, 123

[56] References Cited

U.S. PATENT DOCUMENTS 3,637,474 1/1972 Zuntini et al. ..... 204/47

FOREIGN PATENT DOCUMENTS 2105626 6/1979 Fed. Rep. of Germany ..... 204/47

367587 2/1932 United Kingdom ..... 204/47

*Primary Examiner*—G. L. Kaplan

*Attorney, Agent, or Firm*—Cushman, Darby & Cushman

[57] ABSTRACT

There is described an electrolytic palladium bath containing palladium sulfite and an acid which produces coatings that satisfy all industrial requirements and which is not corrosive to the base metal. The bath contains sulfuric and/or phosphoric acid and employs 80–95% of palladium as palladium sulfate, the balance as palladium sulfite.

25 Claims, No Drawings

ELECTROLYTIC PALLADIUM BATH AND PROCESS

BACKGROUND OF THE INVENTION

The invention is directed to an electrolytic palladium bath containing palladium sulfite and an acid. Such baths serve for the deposition of glossy, flaw free, and low tension palladium coatings for industrial and decorative uses. In the electrical art, palladium coatings are used on contact material; in the decorative industry, they are frequently employed as a replacement for white gold.

The known ammoniacal palladium baths have not been proved practical since, because of the vaporization of ammonia and the sensitivity to impurities, there cannot be maintained constant operating conditions, and the properties of the coatings instead do not satisfy the requirements placed in the art.

Hydrochloric acid baths based on palladium chloride attack a number of base metals during the electrolyzing. Through this, there are not produced sufficiently adhesive coatings, and the palladium frequently deposits in powdery form.

According to German patent No. 2105626, it is possible through the use of palladium nitrate in sulfuric acid solution and through the addition of palladium sulfite to deposit glossy, flaw free, and low tension coatings which fulfill the quality requirements placed in the art.

However, it has now been shown that, in the deposition of the palladium from the palladium nitrate, the nitrate residue can be enriched in the bath as free nitric acid. Through this, a corrosive mixture of sulfuric acid and nitric acid can form which can lead to a corrosion attack with various metals. This impairs the adhesiveness of the palladium coatings. Therefore, it was the problem of the present invention to find an electrolytic, palladium bath containing palladium sulfite and an acid which yields coatings which satisfy the requirements of the art and does not act corrosively on the base metal.

SUMMARY OF THE INVENTION

This problem was solved, according to the invention, by adding to the bath 80 to 95% of the palladium as palladium sulfate and the rest as palladium sulfite. Preferably, it contains 2 to 50 g/l of palladium in the form of palladium sulfate and palladium sulfite. As acids, the bath contains sulfuric acid and/or phosphoric acid, in which case preferably there is used phosphoric acid or a mixture of phosphoric acid and sulfuric acid. Thus, when a mixture of phosphoric acid and sulfuric acid is employed, 10 to 50% by weight can be sulfuric acid and the balance phosphoric acid.

A portion of phosphoric acid in the bath reduces a trifling current free reduction of the palladium which can occur in the bath.

The palladium sulfite causes the formation of gloss and reduces the inner tensions occurring in the deposited coatings.

The bath of the invention preferably contains 2–50 grams of palladium. The content of palladium in the form of the sulfite amounts to 5–20% of the total palladium content. The content of sulfuric acid and/or phosphoric acid advantageously is 40–100 g/l. The bath can be used at temperatures between 20° and 40° C.

The usable current densities are greatly dependent on the palladium content of the bath and the movement of articles and electrolyte and lie between 0.2 and 10 A/dm$^2$.

The current yield is between 95 and 98%, independent of the palladium content in the bath and the current density used.

The bath is produced by dissolving palladium sulfate in sulfuric acid, in phosphoric acid, or a mixture of sulfuric acid and phosphoric acid. Then palladium sulfite solution is added. The palladium sulfite complex, however, can also especially advantageously be produced in the bath itself by the addition of corresponding amounts of sodium sulfite or sulfurous acid to a dissolved palladium salt, e.g., palladium sulfate.

Unless otherwise indicated, all parts and percentages are by weight.

The composition can comprise, consist essentially of, or consist of the stated materials.

The invention is explained in more detail through the following examples.

DETAILED DESCRIPTION

EXAMPLE 1

9 grams of palladium in the form of palladium sulfate were dissolved in 800 grams of 10% sulfuric acid. To the solution there was added 1 gram of palladium in the form of a palladium sulfite solution which was produced by leading sulfur dioxide into a suspension of palladium hydroxide.

Then the bath volume was expanded to 1 liter. At room temperature at 1 A/dm$^2$, there was deposited a 10$\mu$ thick palladium coating on articles. In connection therewith, the bath and articles were in motion. The coating obtained is glossy, completely free from flaws, and had a hardness of HV 340.

EXAMPLE 2

2 grams of palladium in the form of palladium sulfate were dissolved in a mixture of sulfuric acid and phosphoric acid so that the bath contained 40 g/l of sulfuric acid and 60 g/l of phosphoric acid.

There were added 10 ml of sulfurous acid (5–6%). At room temperature, there was deposited a 3$\mu$ thick palladium coating at 0.5 A/dm$^2$, which coating was glossy and free of flaws.

EXAMPLE 3

According to the procedures of Examples 1 and 2, there was produced a bath having the following contents:

20 g/l palladium (as palladium sulfate)
5 g/l palladium (as palladium sulfite)
80 g/l phosphoric acid The bath was quickly rotated in a suitable apparatus by means of a pump. At 30° C. and 6 A/dm$^2$ in the quickly flowing liquid, there was deposited on a sample metal sheet a 5$\mu$ thick palladium coating which was completely glossy and free from flaws.

The entire disclosure of German priority application No. P31 18908.3 is hereby incorporated by reference.

What is claimed is:

1. An electrolytic aqueous palladium nitrate-free bath containing palladium sulfite and an acid wherein the bath contains 80–95% of the palladium as palladium sulfate and the balance as palladium sulfite.

2. An electrolytic bath according to claim 1 which contains 2 to 50 g/l of palladium.

3. An electrolytic bath according to claim 2 containing 40–100 g/l of sulfuric acid, phosphoric acid, or a mixture of phosphoric acid and sulfuric acid.

4. An electrolytic bath according to claim 3 consisting essentially of the stated materials.

5. An electrolytic bath according to claim 3 consisting of the stated materials.

6. A method of electroplating palladium on an article comprising placing the article in the bath of claim 3 and depositing palladium on the article at a temperature of 20°–40° C. and a current density of 0.2–10 A/dm$^2$.

7. An electrolytic bath according to claim 2 containing 40–100 g/l of (1) phosphoric acid alone or (2) a mixture of phosphoric acid and sulfuric acid, the sulfuric acid being present in an amount not over 50% based on the weight of phosphoric acid and sulfuric acid.

8. An electrolytic bath according to claim 7 containing 5 to 20% of palladium in the bath in the form of palladium sulfite produced by the addition of sodium sulfite or sulfurous acid to a palladium salt in the bath itself.

9. An electrolytic bath according to claim 7 consisting essentially of the stated materials.

10. An electrolytic bath according to claim 2 containing 5 to 20% of palladium in the bath in the form of palladium sulfite produced by the addition of sodium sulfite or sulfurous acid to a palladium salt in the bath itself.

11. An electrolytic bath according to claim 2 consisting essentially of the stated materials.

12. A method of electroplating palladium on an article comprising placing the article in the bath of claim 2 and depositing palladium on the article at a temperature of 20°–40° C. and a current density of 0.2–10 A/dm$^2$.

13. An electrolytic bath according to claim 1 containing 40–100 g/l of sulfuric acid, phosphoric acid, or a mixture of phosphoric acid and sulfuric acid.

14. An electrolytic bath according to claim 13 containing 5 to 20% of palladium in the bath in the form of palladium sulfite produced by the addition of sodium sulfite or sulfurous acid to a palladium salt in the bath itself.

15. An electrolytic bath according to claim 13 consisting essentially of the stated materials.

16. An electrolytic bath according to claim 13 containing phosphoric acid as the sole acid.

17. An electrolytic bath according to claim 13 containing sulfuric acid as the sole acid.

18. An electrolytic bath according to claim 1 containing 40–100 g/l of (1) phosphoric acid alone or (2) a mixture of phosphoric acid and sulfuric acid, the sulfuric acid being present in an amount not over 50% based on the weight of phosphoric acid and sulfuric acid.

19. An electrolytic bath according to claim 18 containing 5 to 20% of palladium in the bath in the form of palladium sulfite produced by the addition of sodium sulfite or sulfurous acid to a palladium salt in the bath itself.

20. An elecrolytic bath according to claim 18 consisting essentially of the stated materials.

21. An electrolytic bath according to claim 18 consisting of the stated materials.

22. An electrolytic bath according to claim 18 containing 10 to 50% sulfuric acid based on the weight of phosphoric acid and sulfuric acid.

23. An electrolytic bath according to claim 1 containing 5 to 20% of palladium in the bath in the form of palladium sulfite produced by the addition of sodium sulfite or sulfurous acid to a palladium salt in the bath itself.

24. An electrolytic bath according to claim 1 consisting essentially of the stated materials.

25. A method of electroplating palladium on an article comprising placing the article in the bath of claim 1 and depositing palladium on the article at a temperature of 20°–40° C. and a current density of 0.2–10 A/dm$^2$.

* * * * *